US005435579A

United States Patent [19]

Pozzobon

[11] Patent Number: 5,435,579

[45] Date of Patent: Jul. 25, 1995

[54] SKATE

[75] Inventor: Alessandro Pozzobon, Paderno di Ponzano Vento, Italy

[73] Assignee: Nordica S.p.A., Trevignano, Italy

[21] Appl. No.: 172,952

[22] Filed: Dec. 27, 1993

[30] Foreign Application Priority Data

Jan. 14, 1993 [IT] Italy ..... TV93A0002

[51] Int. Cl.[6] ..... A63C 17/14

[52] U.S. Cl. ..... 280/112; 280/11.22; 188/5

[58] Field of Search ..... 280/11.19, 11.2, 11.22, 280/11.23; 188/5, 6, 7

[56] References Cited

U.S. PATENT DOCUMENTS

| | | | |
|---|---|---|---|
| 1,402,010 | 1/1922 | Ormiston | 280/11.2 |
| 1,497,224 | 6/1924 | Ormiston | 280/11.2 |
| 4,275,895 | 6/1981 | Edwards | 280/11.2 |
| 5,211,409 | 3/1993 | Mitchell et al. | 280/11.2 |
| 5,253,882 | 10/1993 | Mitchell | 280/11.2 |
| 5,316,325 | 5/1994 | Mitchell et al. | 280/11.2 |
| 5,330,207 | 7/1994 | Mitchell | 280/11.2 |

FOREIGN PATENT DOCUMENTS 0567948 11/1993 European Pat. Off. .

*Primary Examiner*—Richard M. Camby
*Attorney, Agent, or Firm*—Guido Modiano; Albert Josif

[57] ABSTRACT

Improved skate including a shoe composed of a shell with which a frame for two or more mutually parallel or aligned wheels is associated. In this skate, a first half-quarter is articulated to the shell and is in turn connected to a braking element. A second half-quarter is furthermore associated with the first half-quarter, and its position with respect to the first half-quarter is adjustable. The skate thus allows both optimum activation of the braking element and quick and easy variation of the support of the leg, for example according to the sport practiced.

11 Claims, 1 Drawing Sheet

SKATE

BACKGROUND OF THE INVENTION

The present invention relates to an improved skate.

Conventional skates with aligned wheels are currently constituted by a shell associated with a frame having two or more wheels.

Among the drawbacks observed in these conventional skates, the fact is stressed that they do not support the user's leg in an optimum manner according to the different needs required by the various sports specialties, such as speed skating or slalom.

The use of levers in fact merely allows to secure the flaps of the shell more or less tightly without allowing any adjustment in the fitting of the shell on the foot.

Technical problems arise in the attempt to apply to the skates the same production method of other fields, such as the field of ski boots, for example, in which a quarter is used in addition to the shell. French patent application no. 7623112, filed on 23 Jul. 1976, discloses a ski boot comprising a supporting element interposed between two flaps obtained at a recess formed on the rear-upper part of the shoe and allowing backward inclination of the skier's leg.

This solution cannot be applied to a skate with aligned wheels, as it is necessary to achieve at all times optimum securing and support of the leg.

Swiss patent application no. CH 668 682 A5, filed on 6 Jun. 1986, discloses a ski boot comprising a quarter articulated to a shell and having securing means interacting, at one end, with said quarter by virtue of fixing means which can be adjusted vertically. For this solution, too, it is possible to improve the securing action according to the inclination of the quarter.

This known solution, too, like the preceding ,one, cannot be used for a skate with aligned wheels, also due to a further problem, namely the presence of a device which allows braking.

Indeed, in this respect, in conventional roller skates, whether constituted by a shoe associated with a support for two pairs of mutually parallel wheels or by a shoe associated with a supporting frame for two or more aligned wheels, there is the problem of braking the wheels to adjust the speed of the skate.

It is known to use adapted blocks or pads, usually made of rubber, arranged at the toe or heel region of the shoe. When the user tilts the shoe forwards or backwards, the free end of the blocks or pads interacts with the ground, and braking is thus achieved.

However, these solutions are not optimum, as they require the user to rotate the shoe, and thus the frame associated therewith, at the toe or at the heel, and this can cause loss of balance with consequent falls.

U.S. Pat. No. 1,402,010 discloses a roller skate having a band that can be secured to the user's leg above the malleolar region and to which a rod is connected.

The rod surrounds the leg at the rear and is then curved so as to laterally affect the leg until it is associated, at its ends, in the malleolar region, with a lever system which is articulated to a structure protruding from the wheel supporting frame.

The lever system protrudes to the rear of the frame and is connected to a plate which is shaped approximately complementarily to the curvature of part of an underlying and facing wheel.

This solution is not free from drawbacks: first of all a relative movement is produced between the band and the leg throughout sports practice, and this does not make its use comfortable due to the continuous rubbing of the band on the leg.

Furthermore, the plate is activated every time the user bends his leg backwards beyond a given angle, with no actual and real possibility of varying this condition.

Since the shape of the leg is different for each user, for the same rod length there is different braking action at different rotation angles.

Furthermore, the rod acts and presses in the malleolar region, and this can cause discomfort or accidental impacts.

The wheel wears out considerably.

As a partial solution to this drawback, U.S. Pat. No. 4,275,895 discloses a brake for skates with two pairs of mutually parallel wheels which acts at the rear wheels.

Said brake is constituted by a tongue associated, in a rearward position, with the shoe; a plate is associated in a rearward position with said tongue and is pivoted at the supporting frame of the shoe.

Said plate has, at its free end, a transverse element on which a pair of C-shaped elements is formed at the lateral ends; said C-shaped elements interact, following a backward rotation imparted to the tongue, with the rear wheels facing them, so as to interact with their rolling surface.

However, this solution, too, has drawbacks; it is in fact structurally complicated and thus difficult to industrialize: it furthermore entails the presence of adapted springs which allow to reposition the tongue in the condition in which the pair of C-shaped elements does not interact with the wheels, and this further increases structural complexity.

The structural configuration of the brake furthermore makes the pair of C-shaped elements interact with the wheel even for a minimal backward rotation imparted to the tongue and thus even for involuntary movements, and this produces unwanted braking actions and therefore possible loss of balance or lack of coordination.

Finally, interaction of the C-shaped element at the rolling surface of the wheels leads to rapid wheel wear and thus to a non-optimum rolling that necessarily entails continuous wheel replacement.

U.S. Pat. No. 4,300,781 discloses a braking device for skates comprising pairs of mutually parallel wheels.

The brake is constituted by a plate pivoted transversely at the rear end of the supporting frame for a shoe; pads facing the rolling surface of the pair of rear wheels are associated with the ends of said plate.

The brake is activated by using a cable suitable to rotate the plate in contrast with a spring associated with the support for the pair of front wheels, so as to move the pads into contact with the rolling surface of the pair of rear wheels.

Said cable can be activated by means of rings or handles associated with a band arrangeable on the user's legs by virtue of temporary connection means.

However, this solution has considerable drawbacks: first of all, brake activation can lead to possible loss of balance during sports practice, since the user does not assume, with his body, a position suitable to control the sudden speed reduction; only the hand of the skater is in fact involved in brake activation.

Furthermore, since sports practice can occur while wearing trousers, when traction is applied to the rings the band may slip along the trousers or may make them slide along the legs, hindering the braking action.

Furthermore, there is a loose cable which in addition to being a hindrance to the skater may accidentally catch during skating, especially since coordination of the arm-legs movement places the legs rhythmically laterally outwards.

SUMMARY OF THE INVENTION

The aim of the present invention is to solve the above described technical problems in the prior art, providing a skate which allows both to achieve optimum support and securing of the user's leg and to obtain the braking action by using a very simple structure which is easy to industrialize.

Another object is to provide a skate in which activation of the braking action can be set by the user when actually required and is thus not accidental and which, at the same time, allows the user to rapidly and easily vary the degree of support of the leg as the sport practiced varies and thus depending on whether one must run a speed or slalom contest.

Another important object is to provide a braking device which can be activated rapidly, simply and safely by the user without forcing him to perform movements, for example with his hands, which might compromise his balance or coordination.

Another object is to obtain a skate which associates with the preceding characteristics that of being reliable and safe in use, has low manufacturing costs and can also be applied to known skates.

With these and other objects in view, there is provided, according to the present invention, an improved skate, comprising a shoe composed of a shell with which a frame for a plurality of wheels is associated, characterized in that a first half-quarter connected to a braking element is articulated to said shell, a second half-quarter being associated with said first half-quarter and being adjustable in its position with respect to said first half-quarter.

BRIEF DESCRIPTION OF THE DRAWINGS

Further characteristics and advantages of the present invention will become apparent from the following detailed description of a particular but not exclusive embodiment thereof, illustrated only by way of non-limitative example in the accompanying drawings, wherein.

DESCRIPTION OF THE PREFERRED EMBODIMENTS

Figure 1:
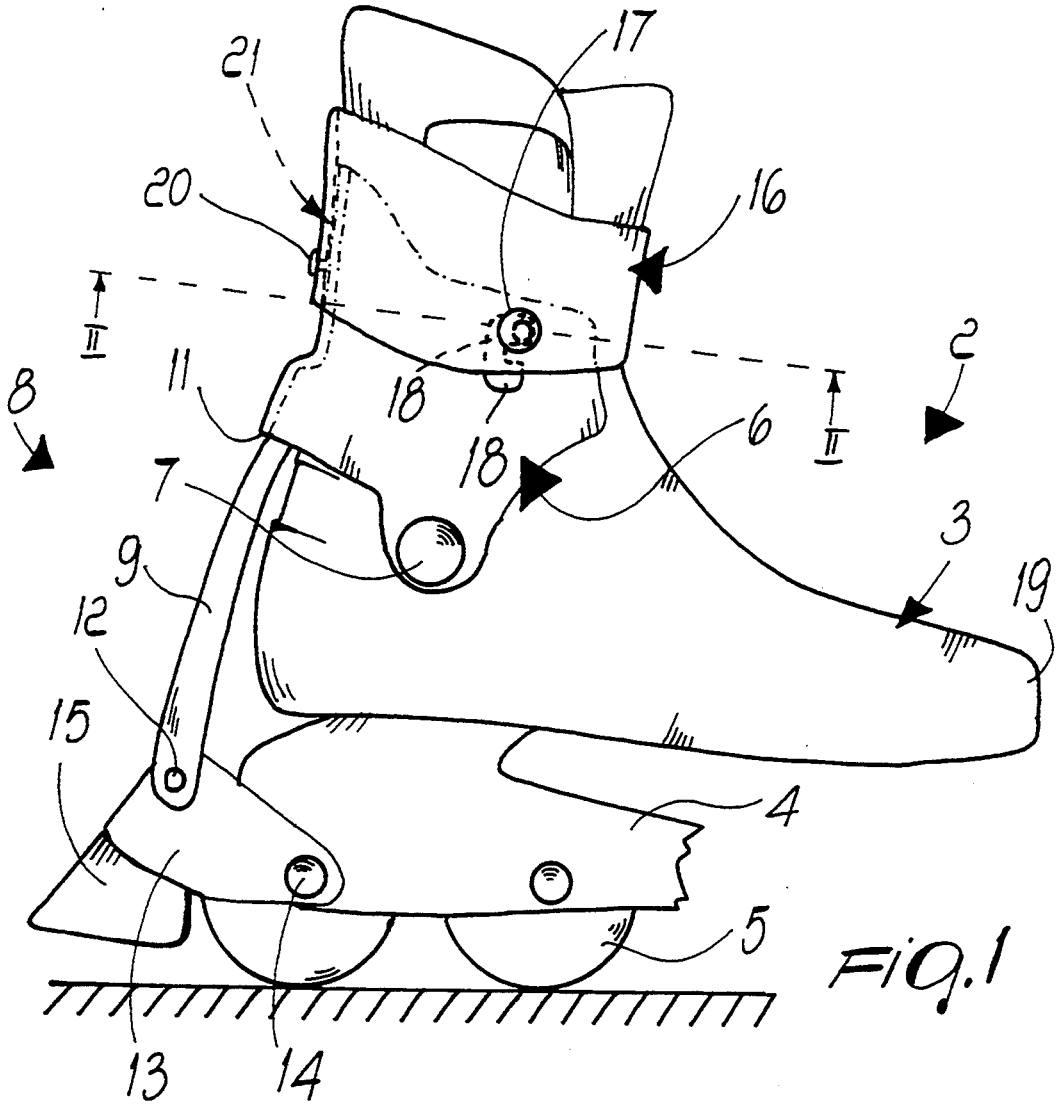
FIG. 1 is a partial side view of the skate according to the invention.

With reference to the above figures, the reference numeral 1 designates the skate, which is constituted by a shoe 2 composed of a shell 3 with which a frame 4 is associated in a lower region and supports two or more wheels 5 arranged mutually parallel in pairs or in a row, as shown in FIG. 1.

A first half-quarter 6 is articulated to the shell 2 by means of a first pair of studs 7 arranged approximately at the malleolar region.

A braking element 8 is associated to the rear of the first half-quarter 6 and is constituted by at least one rod member 9 which at one end is rotatably associated by means of a first pivot 10, transversely to, and to the rear of the first half-quarter 6 proximate to its lower perimetric edge 11.

At its other end, the rod member 9 is rotatably associated, by means of a second pivot 12, with a support 13 which is in turn rotatably associated with the frame 4, preferably at a third pivot 14 for pivoting one or more wheels 5.

An adapted pad 15 protrudes below the support 13 and thus toward the ground and interacts with the ground upon a backward rotation imparted to the first half-quarter 6.

The skate also comprises a second half-quarter 16 associated with the first half-quarter 6 by virtue of means that allow to adjust the mutual arrangement.

Said means are constituted for example by a second pair of studs 17 laterally associated with the second half-quarter 16. The stems of the studs can slide at an adapted pair of guides 18 formed laterally with respect to the first half-quarter 6.

Said pairs of guides 18 are preferably C-shaped and their wings are directed toward the toe 19 of the shell 3.

At least one lug 20 protrudes to the rear of the first half-quarter 6, and a slot 21 is formed at said lug on the second half-quarter 16, which externally surrounds the first half-quarter 6. The purpose of the lug is to guide the sliding of the second half-quarter 16 with respect to the first half-quarter 6.

Figure 3:
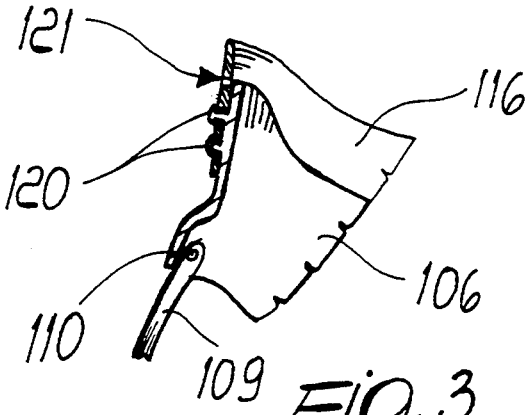
FIG. 3 is a detail partial side view, of a further embodiment of the skate according to the invention.
Figure 2:
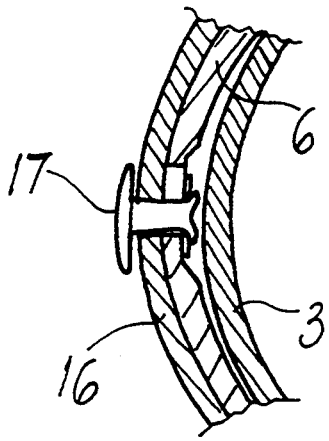
FIG. 2 is a sectional partial view, taken along the plane II—II of FIG. 1.

According to a further aspect of the invention, in replacement of the second pair of studs 17 and of the pair of guides 18 of FIGS. 1 and 2, multiple lugs 120, for example two, may protrude to the rear of the first half-quarter 106, as illustrated in FIG. 3. Multiple holes 121, three formed to the rear of the second half-quarter 116 in the illustrated embodiment, can be selected at said lugs.

The use of the skate therefore allows the user to initially adjust the position of the second half-quarter 16 with respect to the first half-quarter 6 and thus with respect to the shell, and this is possible in a rapid and simple manner by sliding the second pair of studs 17 at the pairs of guides 18 formed on the first half-quarter 6.

Independently of this adjustment, the user may brake the skate with a simple backward rotation of the first half-quarter 6 which causes, due to the presence of the rod member 9, the rotation of the support 13 with respect to the third pivot 14 and thus the interaction of the pad 15 with the ground.

It has thus been observed that the invention has achieved the intended aim and objects, a skate having been obtained in which the braking action can be activated independently of the presetting of the vertical position of the second half-quarter 16 with respect to the first half-quarter 6.

This allows to simultaneously obtain two different functions in a rapid and simple manner for both, the obtainment of one having no effect on the other.

The skate according to the invention is susceptible to numerous modifications and variations, all of which are within the scope of the same inventive concept.

Naturally, the materials and the dimensions of the individual components of the skate may be the most pertinent according to the specific requirements.

I claim:

1. A skate, comprising: a shoe composed of a shell with which a frame for a plurality of wheels is connected; a first half-quarter connected to a braking element, the first half-quarter being articulated to said shell; a second half-quarter connected with said first half-quarter and being adjustable in its position with respect to said first half-quarter, wherein said first half-quarter is articulated to said shell by means of a first pair of studs and at least partially surrounds the user's leg, an end of a rod member being transversely and rotatably connected, by means of a first pivot, to the rear of said first half-quarter; said rod member being rotatably connected, at its other end, by means of a second pivot, with a support which is in turn rotatably connected with said frame and which has a pad directed toward the ground.

2. Skate according to claim 1, wherein said second half-quarter is connected with said first half-quarter by virtue of means that allow to adjust their mutual arrangement, said means being constituted by a second pair of studs which are laterally connected with said second half-quarter, the stems of said studs sliding at an adapted pair of guides formed laterally with respect to said first half-quarter.

3. Skate according to claim 2, wherein said second half-quarter surrounds at least partially the skater's leg and is arranged outside said first half-quarter.

4. Skate according to claim 1, wherein said second half-quarter is connected with said first half-quarter by virtue of means that allow to adjust their mutual arrangement, said means being constituted by a second pair of studs which are laterally connected with said second half-quarter, the stems of said studs sliding at an adapted pair of guides formed laterally with respect to said first half-quarter, said pair of guides being C-shaped and having wings directed toward the toe of said shell.

5. Skate according to claim 1, wherein said second half-quarter is connected with said first half-quarter by virtue of means that allow to adjust their mutual arrangement, said means being constituted by a second pair of studs which are laterally connected with said second half-quarter, the stems of said studs sliding at an adapted pair of guides formed laterally with respect to said first half-quarter, said pair of guides being C-shaped and having wings directed toward the toe of said shell, a lug protruding to the rear of said first half-quarter and being arrangeable at a slot formed on said second half-quarter.

6. A skate, comprising: a shoe composed of a shell with which a frame for a plurality of wheels is connected; a first half-quarter connected to a braking element, the first half-quarter being articulated to said shell; a second half-quarter connected with said first half-quarter and being adjustable in its position with respect to said first half-quarter by means for adjusting the mutual arrangement, wherein said means for adjusting the mutual arrangement are constituted by a plurality of lugs protruding to the rear of said first half-quarter and are arrangeable at a plurality of holes on said second half-quarter.

7. A skate comprising: a shell for a user's foot; a frame connected below said shell; a plurality of wheels; means for rotatably supporting said plurality of wheels at said frame; a first half-quarter; means for articulating said first half-quarter to said shell; a braking element including a support rotatably pivoted to said frame and extending rearwardly therefrom; means for interconnecting said support with a portion of said first half-quarter thereby for pivoting said support between a braking position and a non-braking position depending upon a position assumed by said first half-quarter; a second half-quarter; and connection means for connecting said second half-quarter to said first half-quarter; wherein said connection means are adjustable connection means for adjustably connecting said second half-quarter to said first half-quarter thereby said second half-quarter being adjustably positionable in a substantially vertical direction with respect to said first half-quarter.

8. The skate of claim 7, wherein said connection means comprise a lug and slot connection provided between the first half-quarter and the second half-quarter at a rear portion of the skate.

9. The skate of claim 8, wherein said lug and slot connection comprises a plurality of lugs.

10. The skate of claim 8, wherein said connection means further comprise a pair of guide and stud connections provided between the first half-quarter and the second half-quarter at opposite lateral portions of the skate.

11. The skate of claim 10, wherein said pair of guide and stud connections comprise C-shaped guides.

* * * * *